United States Patent [19]

Horiuchi

[11] Patent Number: 4,989,533

[45] Date of Patent: Feb. 5, 1991

[54] SUPPORT STRUT FOR HYDROFOIL CRAFT

[75] Inventor: Kotaro Horiuchi, Iwata, Japan

[73] Assignee: Yamaha Hatsudoki Kabushiki Kaisha, Iwata, Japan

[21] Appl. No.: 374,290

[22] Filed: Jun. 30, 1989

[30] Foreign Application Priority Data

Jul. 4, 1988 [JP] Japan ..... 63-166488

[51] Int. Cl.[5] ..... B63B 1/26; B63H 11/103

[52] U.S. Cl. ..... 114/278; 440/47

[58] Field of Search ..... 114/278, 274; 440/47, 440/38, 40, 41, 42, 43

[56] References Cited

U.S. PATENT DOCUMENTS

| | | | |
|---|---|---|---|
| 3,006,307 | 10/1961 | Johnson | 114/278 |
| 3,055,331 | 9/1962 | Singelmann | 114/278 |
| 3,106,179 | 10/1963 | Traksel et al. | 114/278 |
| 3,143,097 | 8/1964 | Meyerhoff | 114/278 |
| 3,348,514 | 10/1967 | Davis | 114/278 |
| 3,745,959 | 7/1973 | Coffey et al. | 114/278 |
| 3,763,818 | 10/1973 | Davis | 440/47 |
| 3,968,762 | 7/1976 | Meyer | 114/278 |

*Primary Examiner*—David H. Brown

*Attorney, Agent, or Firm*—Ernest A. Beutler

[57] ABSTRACT

A supporting strut for a hydrofoil type of watercraft that also incorporates a water inlet for a jet propulsion unit. In accordance with the invention, the strut has a generally triangular configuration and a smooth transition from the lower water inlet end to at least the water level so as to reduce turbulence and improve performance.

3 Claims, 4 Drawing Sheets

SUPPORT STRUT FOR HYDROFOIL CRAFTBACKGROUND OF THE INVENTION

This invention relates to a support strut for a hydrofoil type of craft and more particularly to an improved combined water inlet and strut for such a watercraft.

There is a very popular of type of hydrofoil watercraft that is propelled by a jet propulsion unit that is comprised of a water inlet which is formed at the lower end of one of the support struts for the watercraft and a jet pumping unit and water outlet that are positioned within the hull of the watercraft and driven by an engine supported therein. In accordance with this type of watercraft and particularly the combined support strut and water intake device, it is the practice to utilize a forwardly facing water inlet that has a substantial cross sectional area so as to insure adequate water flow and the appropriate propulsion force. However, since the support strut is at least partially submerged in the water even during high speed transport, it is desirable to insure that the strut has a configuration that will provide minimum water resistance.

This gives rise to certain problems which can be best understood by reference to FIGS. 1, 2 and 3 of the drawings wherein FIG. 1 illustrates a side elevational view of a combined support strut and water intake device for a jet propelled hydrofoil type of watercraft, the overall construction of which will be described further in the specification of this application. As may be seen, a combined supporting strut and water intake is identified generally by the reference numeral 11 and is comprised of a base portion 12 that is constructed so as to be affixed to the underside of the hull in an appropriate manner. A strut 13 depends from the base portion 12 and terminates at its lower end in a water intake portion 14 having a generally forwardly facing water inlet opening 15 which, as may be seen in FIG. 3, is generally rectangular in configuration.

Positioned rearwardly of the intake portion. 14 is a rudder like part having a hydrofoil 16 that is used to provide hydrodynamic lift. It will be noted that the square or rectangular shape of the inlet opening 15 gives rise to a transitional problem in an area indicated by the arrow 17 wherein the shape goes from a generally rectangular cross-sectional shape to a generally teardrop or oval shape portion as shown in FIG. 2 so as to try to improve streamlining and reduce water resistance. However, as a result of this configuration, there is turbulence created which increases the water drag and also causes a spray in the area indicated by the arrow b to be formed which will be objectionable.

It is, therefore, a principal object of this invention to provide an improved support strut and water intake for a hydrofoil type of watercraft.

It is a further object of this invention to provide an improved configuration and construction for such a combined support strut and water intake.

SUMMARY OF THE INVENTION

This invention is adapted to be embodied in a support strut for a hydrofil type watercraft having a hull and a support strut depending from the hull to a position beneath the water level. The support strut has a forwardly facing water inlet formed at its lower end. In accordance with the invention, the support strut has a generally triangular shape in planes parallel to the water level at least along the portion of the support strut above the water inlet and in proximity to the water level.

DETAILED DESCRIPTION OF THE PREFERRED EMBODIMENT

Figure 1:
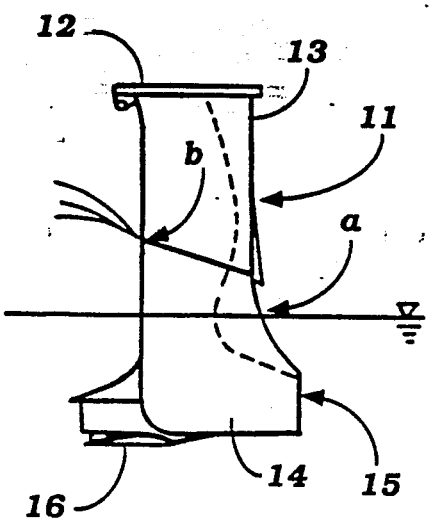
Figure 1 Prior Art
FIG. 1 is a side elevational view of a combined support strut and water intake device of a hydrofoil watercraft constructed in accordance with the teachings of the prior art.
Figure 2:
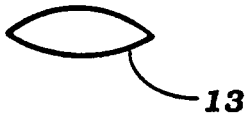
FIG. 2 is a cross-sectional view taken along a plane parallel to the water level and approximately at the water level during normal high speed operation.
Figure 3:
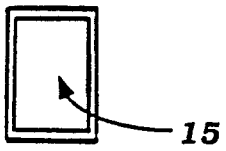
FIG. 3 is a front elevational view showing the configuration of the water inlet.
Figure 4:
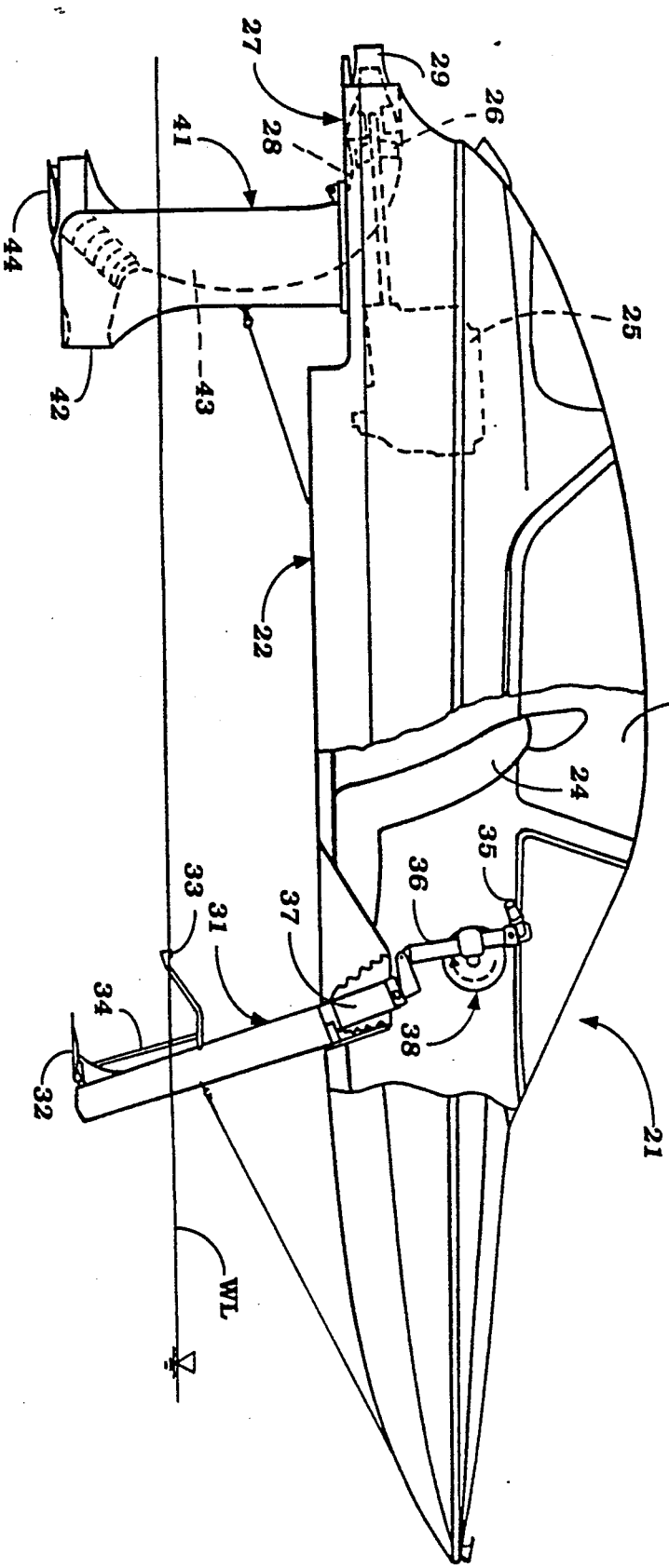
FIG. 4 is a side elevational view, with portions broken away, of a jet propelled watercraft constructed in accordance with an embodiment of the invention.

Referring now in detail to the drawings of the embodiment of the invention and particularly to FIG. 4, a jet propelled hydrofoil type of watercraft constructed in accordance with an embodiment of the invention is identified generally by the reference numeral 21. The watercraft 21 is comprised of a hull, indicated generally by the reference numeral 22 and which contains a passenger compartment 23 in which a driver's seat 24 is positioned.

Rearwardly of the passenger compartment 23, the hull is provided with an engine compartment in which an internal combustion engine 25 of any known type may be supported. The engine 25 drives an impeller 26 of a jet propulsion unit, indicated generally by the reference numeral 27. The jet propulsion unit 27 has a water inlet 28 that receives water from the body of water in which the watercraft is operating in a manner to be described. The water is pressurized by the impeller 26 and discharge through a discharge nozzle 29 for propelling the watercraft 21 in a known manner.

The hull 22 is normally supported above the water level WL during operation by means including a front support strut 31. The support strut 31 carries a hydrofoil device 32 at its lower end which is adjusted by means of a skimmer 33 and interconnecting link 34 so as to provide the desired degree of hydrodynamic lift to the hull 22. In addition, there is provided a steering handlebar 35 which is coupled to a steering shaft 36 and the strut 31 for steering it relative to a journal 37 to effect steering of the watercraft 21. A stabilizer device 38 of the type disclosed in the copending application entitled "Lateral Stabilization Device For Entirely Submerged Type Hydrofoil Craft", Ser. No. 344,692, filed Apr. 28, 1989 in the name of Fumitaka Yokoyama and assigned to the assignee of this application, can be employed for assisting in the stabilization and steering of the watercraft 21.

Figure 5:
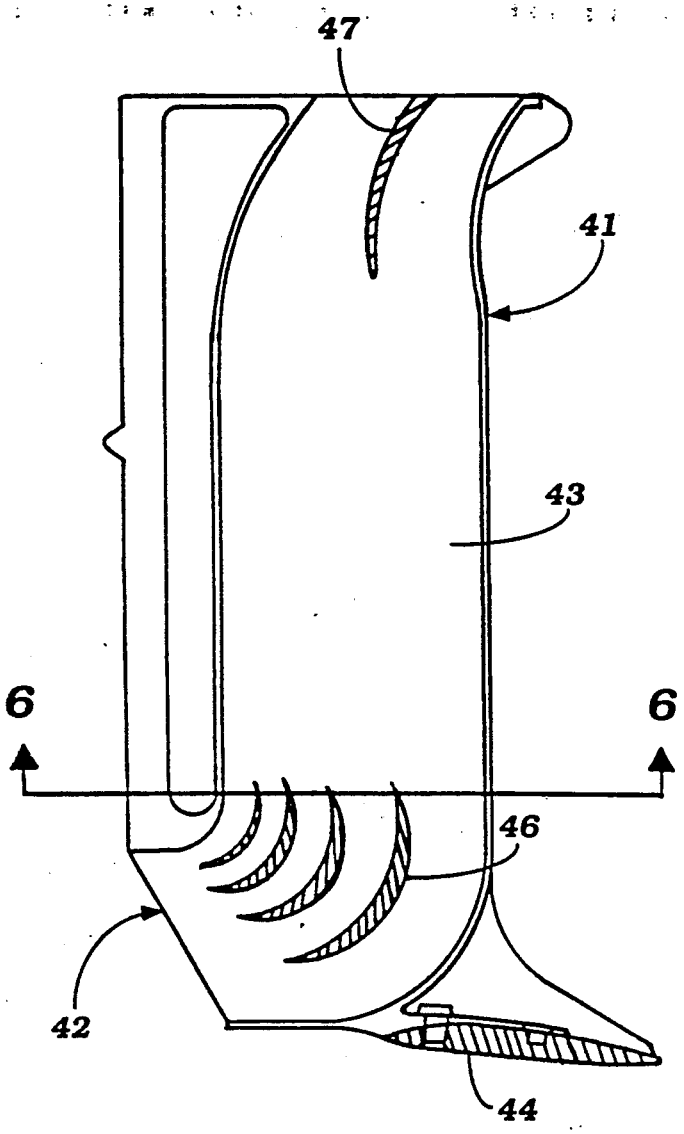
FIG. 5 is a side elevational view, with a portion shown in section, of the combined strut and water inlet.
Figure 6:
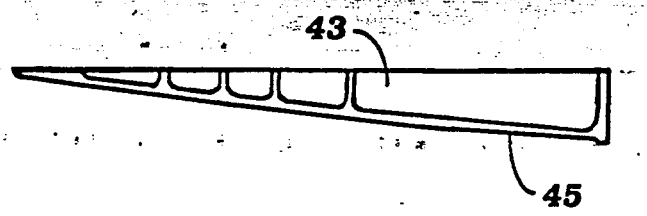
FIG. 6 is a cross-sectional view taken along the line 6—6 of FIG. 5.
Figure 7:
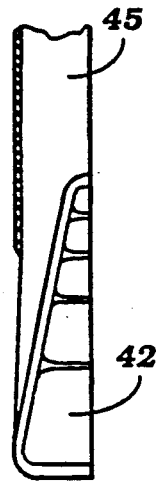
FIG. 7 is a front elevational view showing the water inlet.

At the rear of the hull 22 there is positioned a rear supporting strut and water intake device, indicated generally by the reference numeral 41 and which is shown in most detail in FIGS. 5 through 7. This strut and water intake 41 has a forwardly facing intake opening 42 and an internal passageway 43 that delivers water to the jet propulsion unit inlet 28. In addition, there is provided a rear hydrofoil 44 for providing the desired hydrodynamic lift.

Referring now additionally and primarily to FIGS. 5 and 6, it should be noted that the support strut 41 is comprised of a pair of mating members 45, only one of these being shown in FIGS. 6 and 7. The mating members 45 have a generally triangular configuration and define the forwardly facing water inlet opening 42 which, it should be noted, is of a somewhat triangular configuration so as to provide a smooth transition between the water inlet and the main portion of the supporting strut 41. There are provided vanes 46 adjacent the inlet 42 for redirecting the water upwardly along the length of the strut 41 through the passageway 42 and further vanes 47 at the upper end thereof for redirecting it to the jet propulsion unit inlet 28.

It has been found that the triangular configuration resulting from the mating halves 45 provides a very good transition, does not sacrifice the water intake area and, furthermore, does not create turbulence and the spray problems attendant with the prior art constructions as aforedescribed.

Therefore, it should be clear that the described construction is highly effective in insuring the desired result. It is to be understood that this description is that of a preferred embodiment of the invention and that various changes and modifications may be made without departing from the spirit and scope of the invention, as defined by the appended claims.

I claim:

1. A support strut for a hydrofoil craft having a hull and a support strut depending from said hull to a position beneath the water level, said support strut having a forwardly facing water inlet formed in its lower end, said supporting strut having a triangular shape in planes parallel to said water level at least along the portion of said support column above said water inlet and in proximity to the water level.

2. A support strut for a hydrofoil craft having a hull and a support strut depending from said hull to a position beneath the water level, said support strut having a forwardly facing water inlet formed in its lower end, said supporting strut having a generally triangular shape in planes parallel to said water level at least along the portion of said support column above said water inlet and in proximity to the water level, said water level having a generally triangular shape tapering upwardly from the lower end of the supporting strut.

3. A support strut as set forth in claim 2 wherein the supporting strut is formed by a pair of mating triangular shaped portions with the apex thereof being disposed at the forward end thereof.

* * * * *